United States Patent [19]

Brennan

[11] Patent Number: 5,046,725

[45] Date of Patent: Sep. 10, 1991

[54] VARIABLE WEIGHT GRIP EXERCISER

[76] Inventor: Dean R. Brennan, 4263 Memorial Hwy., North Miami, Fla. 33161

[21] Appl. No.: 193,073

[22] Filed: May 12, 1988

[51] Int. Cl.[5] ..... A63B 21/06

[52] U.S. Cl. ..... 272/118; 272/67

[58] Field of Search ..... 272/118, 117, 67–68, 272/93

[56] References Cited

U.S. PATENT DOCUMENTS

| | | | |
|---|---|---|---|
| 372,272 | 10/1887 | Murphy | 272/118 |
| 3,257,111 | 6/1966 | Martin | 272/118 |
| 3,346,256 | 10/1967 | White | 272/118 |
| 3,606,316 | 9/1971 | Krewer | 272/67 |
| 4,010,947 | 3/1977 | Lambert, Sr. | 272/118 |
| 4,200,279 | 4/1980 | Lambert, Jr. | 272/118 |
| 4,601,466 | 7/1986 | Lais | 272/118 |
| 4,621,807 | 11/1986 | Stramer | 272/117 |
| 4,632,388 | 12/1986 | Schleffendorf | 272/118 |
| 4,679,788 | 7/1987 | Adler | 272/93 |

OTHER PUBLICATIONS

Super Grip Machine; Dan Lurie Barbell Co., Inc. from Dan Lurie's Muscle Training Magazine, Jan. 1985, p. 17.

*Primary Examiner*—Stephen R. Crow
*Assistant Examiner*—D. F. Crosby
*Attorney, Agent, or Firm*—Alvin S. Blum

[57] ABSTRACT

A variable weight exercise machine is expressly engineered for exercising the gripping muscles of the hand. The machine includes a movable carriage mounted for vertical reciprocating motion by riding on a pair of vertical guide bars. The guide bars are rigidly mounted on a support frame along with a fixed handle bar. A movable handle bar is mounted on the carriage. A weight bearing bar is affixed to the carriage. The weight bearing bar passes through a stack of the weights. A series of transverse holes in the weight bearing bar are in registry with transverse holes in the weights. A locking pin is passed through a transverse hole in a selected weight and through the corresponding hole in the weight bearing bar to lock the selected weight and all those above it to the carriage. Bringing the movable handle bar to the fixed handle bar by hand gripping action lifts the carriage and the selected weights.

11 Claims, 5 Drawing Sheets

VARIABLE WEIGHT GRIP EXERCISER

BACKGROUND OF THE INVENTION

This invention relates to exercise machines and more particularly to a machine for strengthening the hand grip that employes variable captive weights.

Exercisers manufactured exclusively for strengthening the gripping muscles of the hand, as exemplified by U.S. Pat. Nos. 1,495,278 and 689,652 generally employ a spring biasing force aganist which the gripping hand acts. Exercising machines employing an adjustable variable stack of weights to be lifted, as exemplified by U.S. Pat. Nos. 4,456,245; 4,627,615: 4,577,861 and 4,606,540, have the advantage of precise forces against which the muscles must act, however they have general exercise utility and are not designed specifically for the special function of hand grip exercising. Consequently, they cannot perform this function in an optimal manner.

The prior art device shown in FIG. 1 has been used for grip exercising with a spindle 1 upon which removable bar bell disc weights 2 of various sizes may be mounted. The carriage 3 lifts the spindle 1 and the mounted weights 2 when the movable handle 4 attached to carriage 3 is pulled upward toward the stationary handle 5 by gripping motion of the hand. This device has the economic advantage of not requiring its own set of weights. However, it has the disadvantage of requiring the lifting on and off of weights to adjust resistance. The device is not suitable for a health club application wherein multiple users may misplace weights. Furthermore, its structure interferes with comfortable use.

SUMMARY OF THE INVENTION

It is accordingly an object of the invention to provide an exercise machine designed especially for exercising of the grip muscles of the hand that is comfortable and easy to use.

It is yet another object of the invention to provide such a machine with a supply of adjustable weights that are captive, wherein the number of weights to be lifted in the exercise may be adjusted without lifting weights on and off the machine.

The invention includes a frame supporting a pair of vertical guides; a stack of weights, each weight having three vertical holes arranged in a line with the vertical guides passing through the two outer holes; a carriage mounted atop the weights and riding up and down on the vertical guides which pass through vertical holes in the carriage; and a vertical weight-attaching means affixed to said carriage and extending downward through the center hole of each weight and adapted for engaging any number of weights by a simple locking pin means. A horizontal handle bar is connected to the carriage for lifting the carriage with its attached weights. The handle bar is at right angles to a line between the holes in the weights. A stationary horizontal handle bar is affixed to the frame above and parallel to the movable handle bar. A gripping motion of the hand lifts the movable handle and its attached weights toward the stationary handle bar. By simply adjusting the locking pin when the carriage is down, weights may be added or removed from the carriage without handling them. The weights cannot be removed from the machine.

The features, objects and advantages of the invention will be more evident to those skilled in the art in light of the accompanying illustrations and detailed description:

DETAILED DESCRIPTION OF PREFERRED EMBODIMENT OF THE INVENTION

Figure 1:
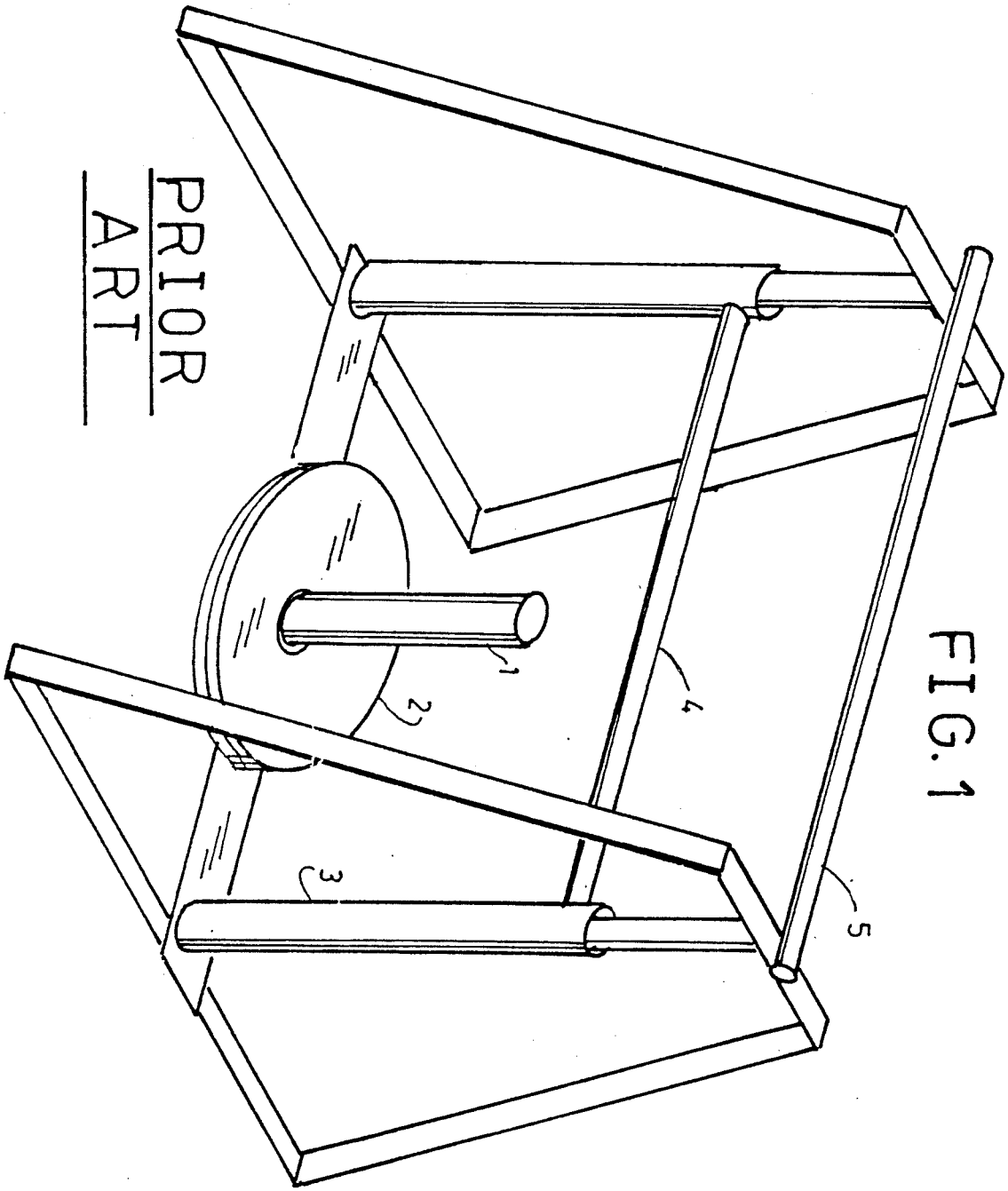
FIG. 1 PRIOR ART
FIG. 1 is a perspective view of a grip exerciser of the prior art.
Figure 2:
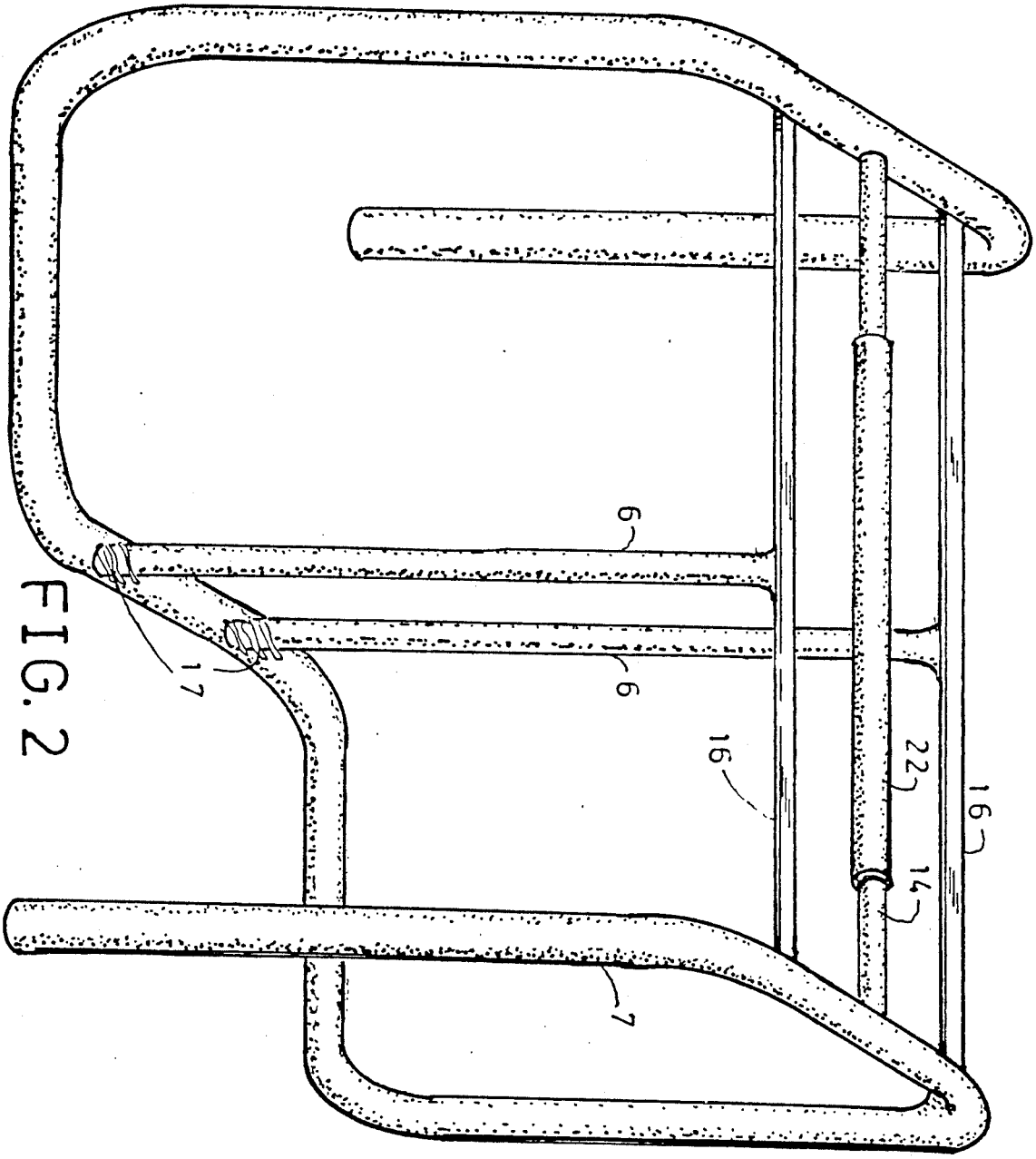
FIG. 2 is a perspective view of the frame of the grip exerciser of the invention.
Figure 3:
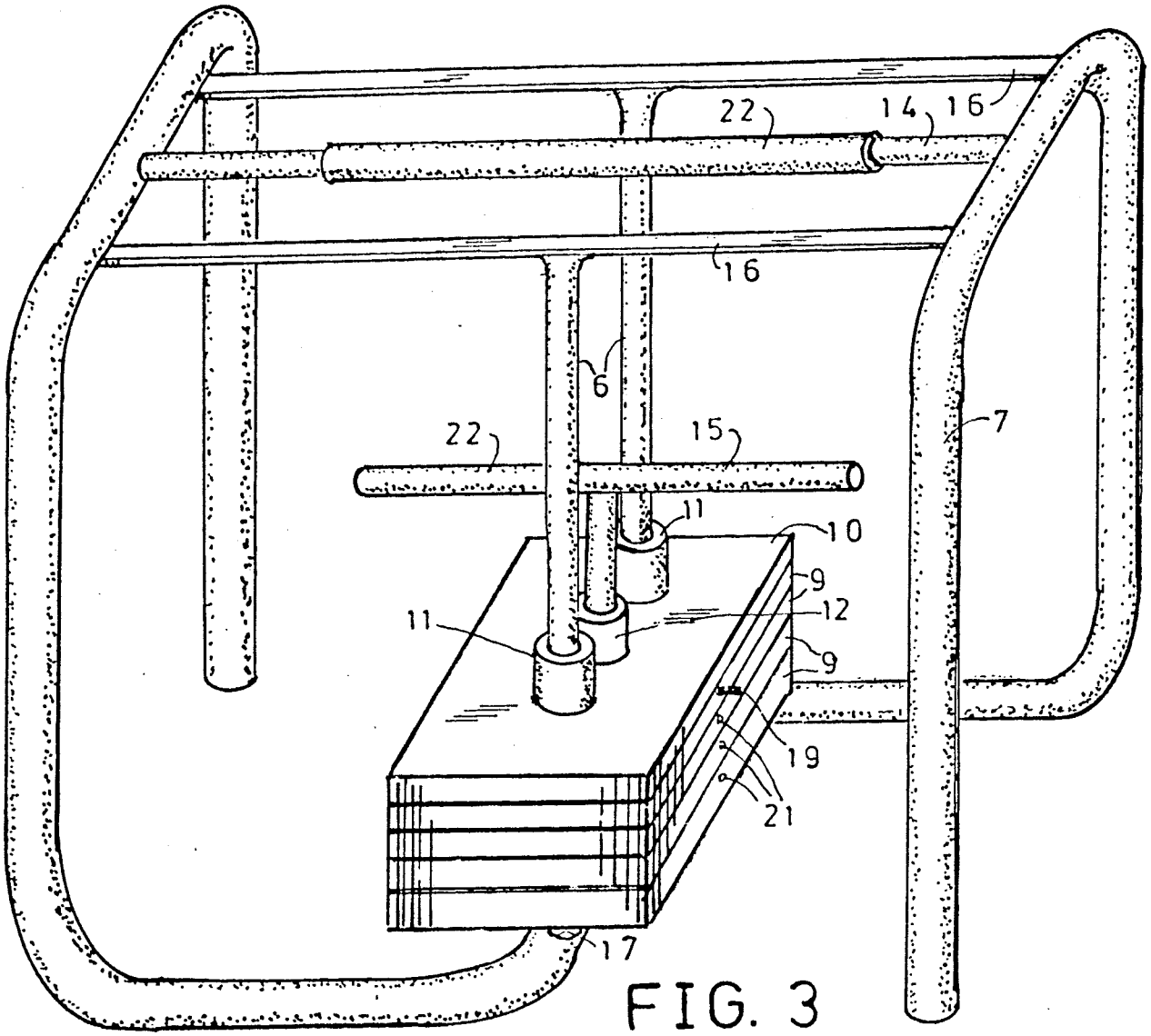
FIG. 3 is a perspective view of the grip exerciser of the invention.
Figure 4:
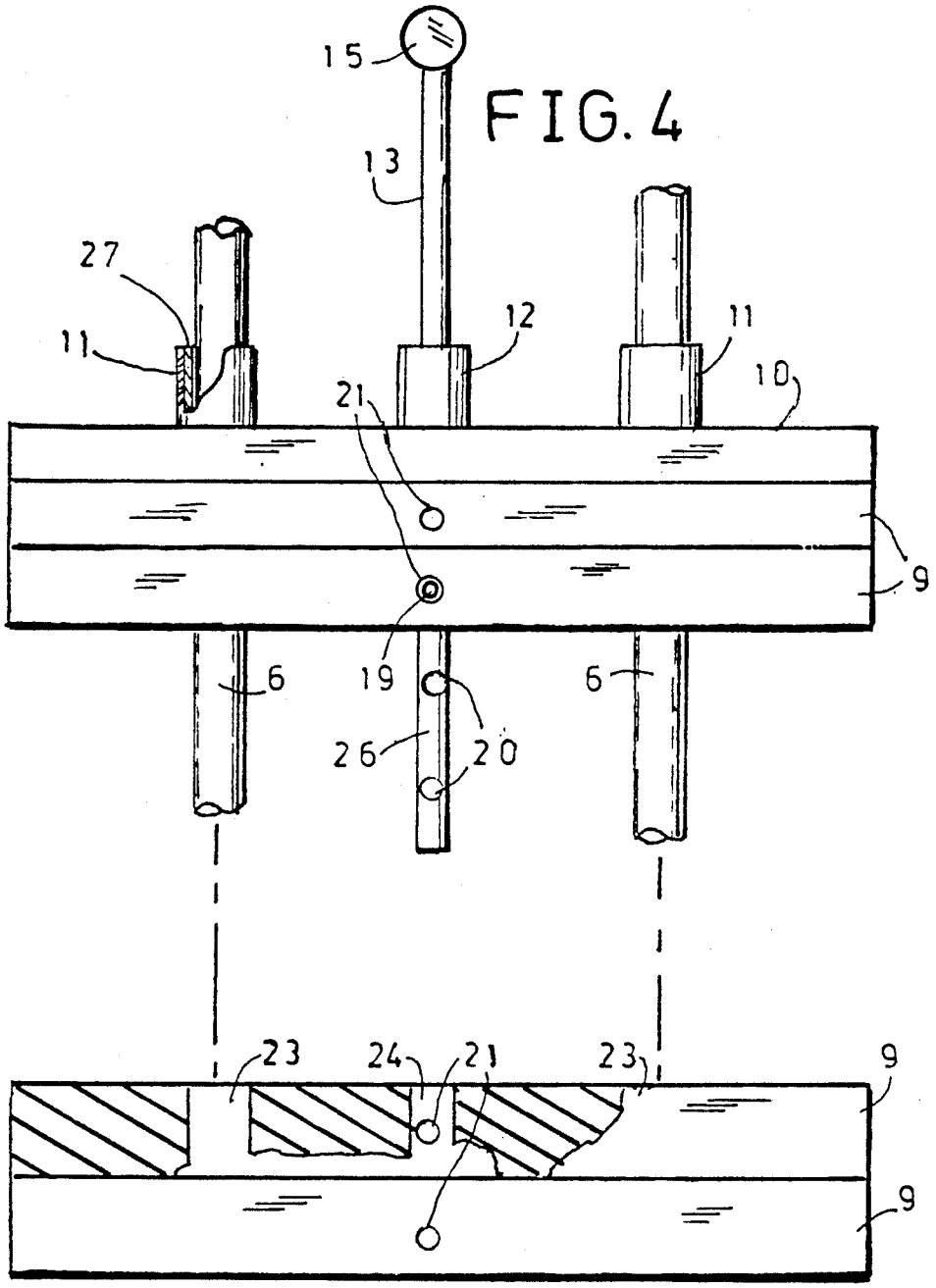
FIG. 4 is a side elevation detail of the carriage and weights of FIG. 3.

Referring now first to FIG. 2, a supporting frame 7 of bent tubing supports crosspieces 16 holding vertical guide bars 6. Compression springs 17 cushion the fall of the weights. Also supported by supporting frame 7 is fixed handle bar 14. FIGS. 3 and 4 illustrate how carriage 10 with collars 11 fixedly connected thereto rides up and down on vertical guide bars 6. Lubricous sleeve bearings of nylon 27 within collars 11 reduce friction and provide a smooth sliding motion of carriage 10 as is well known in the art. A central collar 12 is connected to carriage 10 midway between collars 11. The collar 12 secures weight-bearing rod 13 to carriage 10. Movable handle bar 15 is connected at right angles to weight-bearing rod 13. Both handle bars may be covered with a cushioned gripping surface material 22. The weight-bearing rod 13 passes below carriage 10 to a lower portion 26 having transverse holes 20 for engaging locking pin 19. Each weight 9 has three vertical holes. A pair of holes 23 permit free passage of guide bars 6. A central hole 24 provides passage for weight-bearing rod 13. Each weight 9 also has a transverse hole 21 for engaging locking pin 19.

The carriage 10 normally rests upon the stack of weights 9. In this position, the weight-bearing rod passes through the central vertical hole 24 in each weight and the transverse holes 20 in rod 13 are in registry with transverse holes 21 in the weights. By inserting the locking pin 19 through the hole 21 in a selected weight it penetrates the corresponding hole 20 in the rod. That weight and all the weights above it are thereby locked to the carriage and the lower weights remain at rest, free of the carriage.

Figure 5:
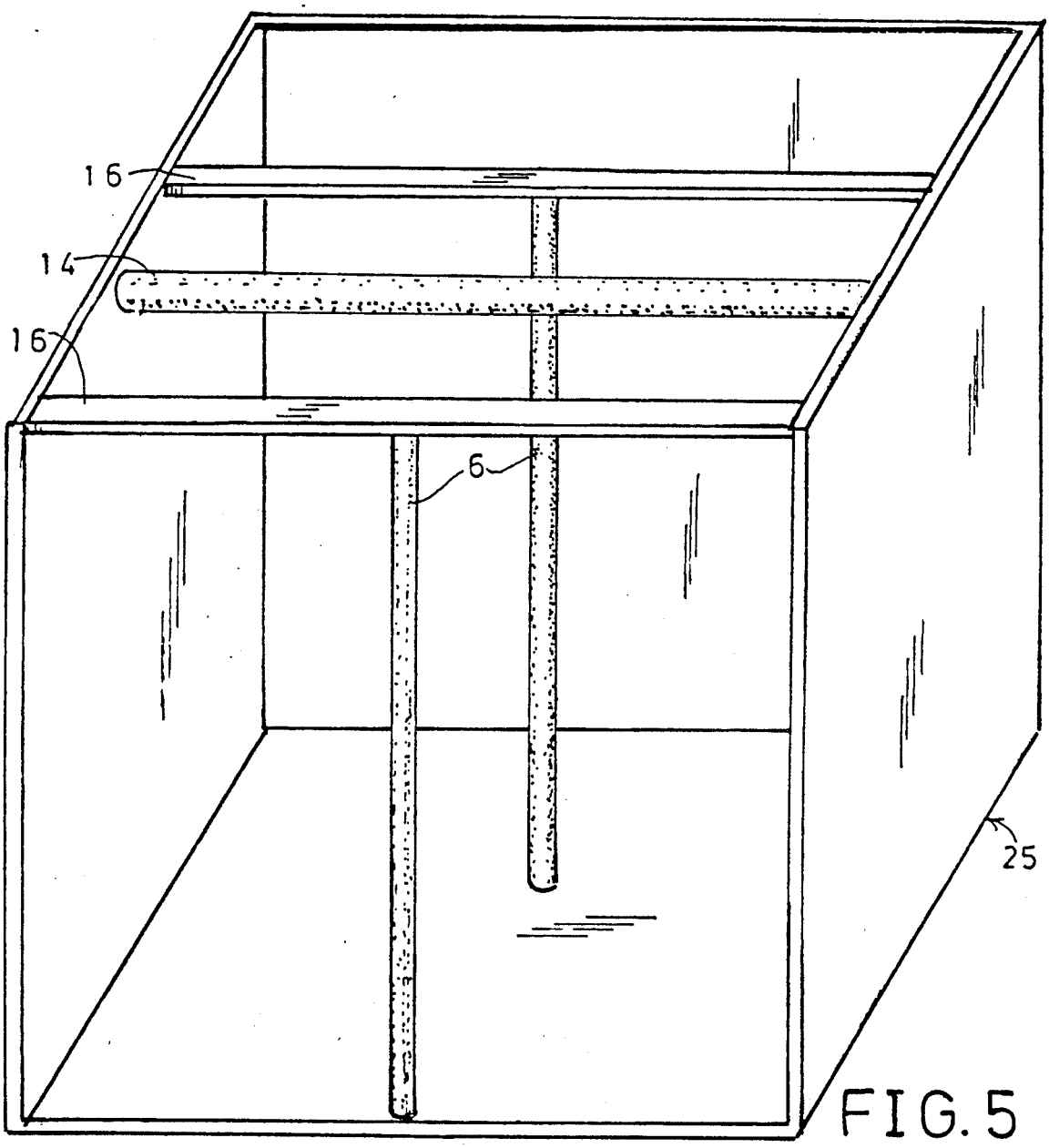
FIG. 5 is a perspective view of an alternative embodiment of the frame of the exerciser made of steel plate.

To operate the machine, the user raises the movable handle bar 15 up to the fixed handle bar 14 with ordinary lifting muscles and encircles both bars with each hand. Relaxing and contracting the hand grip then lowers and raises the weights. The forces applied are exactly known and adjustable by adding or removing weights. The weights cannot be removed or misplaced. With the carriage at rest atop the weights, weights are added or removed by changing the position of pin 19 without any moving or lifting of weights. Having the long dimension of the weights at right angles to the handle bars enables the user to bring a foot up beside the weights to position his or her arms and shoulders over the weights without bending far forward for more comfortable operation without excessive straining of the back muscles. FIG. 5 shows a frame 25 made up of steel plate to provide the same function as the tubular frame 7 of FIG. 2 as an alternative embodiment.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

What is claimed:

1. A grip exercise machine for exercising the gripping muscles of the hands comprising:

(a) a support frame;

(b) a pair of horizontally arranged support bars connected to said support frame in spaced parallel relation;

(c) a pair of spaced parallel vertical guide members, a first said guide member connected at its upper end to a first said support bar and a second said guide member connected at its upper end to a second said support bar and each said guide member connected at its lower end to said support frame;

(d) a first horizontal handle bar arranged between said support bars and substantially paralllel thereto, said first handle bar fixedly connected at its ends to said support frame;

(e) a carriage means arranged for vertical reciprocation;

(f) anti-friction means on said carriage means for engaging about said vertical guide members for guiding said carriage means for vertical reciprocation, said carriage means being guided only by said guide members and not engaging said support frame at any position of said vertical reciprocation;

(g) a plurality of weights capitively mounted for vertical sliding movement on said guide members beneath said carriage means;

(h) weight connecting means depending from said carriage means for selective connection to said weights for moving the connected weights with said carriage means on vertical sliding movement of said carriage means;

(i) rigid connecting means extending upward from said carriage means between said vertical guide members; and (j) a second horizontal handle bar fixedly connecting to said rigid connecting means substantially at right angles thereto, said second handle bar arranged parallel to and beneath said first handle bar in such manner that the two said handle bars may be approximated and may be encircled by said hands, wherein said exercising of said gripping muscles raises and lowers said second handle bar toward and away from said first handle bar, thereby raising and lowering said carriage means and said selected weights connected to said carriage means.

2. The exercise machine according to claim 1 in which said anti-friction means is a lubricous plastic sleeve.

3. The exercise machine according to claim 1 in which said handle bars are covered with a cushioned covering material.

4. The exercise machine according to claim 1 further including spring means arranged about said guide members beneath said weights.

5. The exercise machine according to claim 1 in which said frame support is constructed substantially of bent tubing.

6. The exercise machine according to claim 1 in which said frame support is constructed substantially of flat plates joined together.

7. The exercise machine according to claim 4 in which said anti-friction means is a lubricous plastic; said handle bars are covered with a cushioned covering material; and said frame support is constructed substantially of bent tubing.

8. The exercise machine according to claim 4 in which said anti-friction means is plastic; said handle bars are covered with a cushioned covering material; and said frame support is constructed substantially of flat plates joined together.

9. The exercise machine according to claim 8 in which said selective connection of said selected weights to said weight-connecting means includes a locking pin means engaging horizontal holes in said weight connecting means and said weights.

10. The exercise machine according to claim 1 in which said selective connection of said selected weights to said weight-connecting means includes a locking pin means engaging horizontal holes in said weight-connecting means and said weights.

11. A grip exercising machine for exercising the gripping muscles of the hands, comprising:

(a) a support frame;

(b) a pair of support bars arranged in a common horizontal plane and connected to said support frame in spaced parallel relation;

(c) a first vertical guide member connected at its upper end to a first of said support bars; p1 (d) a second vertical guide member connected at its upper end to a second of said support bars and substantially parallel to said first guide member;

(e) connections fixedly connecting the lower ends of both said guide members to said support frame;

(f) a first horizontal handle bar arranged between said support bars and substantially parallel thereto, said first handle bar fixedly connected at its ends to said support frame;

(g) a carriage means arranged for vertical reciprocation;

(h) a plurality of weights mounted for vertical sliding movement on said guide members beneath said carriage means;

(i) weight connecting means depending from said carriage means for selective connection to said weights for moving the connected weights with said carriage means on vertical sliding movement of said carriage means;

(j) rigid connecting means extending upward from said carriage means between said vertical guide members; and (k) a second horizontal handle bar fixedly connected to said rigid connecting means substantially at right angles thereto, said second handle bar arranged parallel to and beneath said first handle bar in such manner that the two said handle bars may be approximated and may be encircled by said hands, wherein said exercising of said gripping muscles raises and lowers said second handle bar toward and away from said first handle bar, thereby raising and lowering said carriage means and said selected weights connected to said carriage means.

* * * * *